US010562741B2

(12) United States Patent
Eder et al.

(10) Patent No.: US 10,562,741 B2
(45) Date of Patent: Feb. 18, 2020

(54) METHOD FOR MODERNIZING AN ESCALATOR OR A MOVING WALKWAY

(71) Applicant: INVENTIO AG, Hergiswil (CH)

(72) Inventors: Christoph Eder, Vienna (AT); Eva Karall, Vienna (AT); Jürg Burri, Hirschthal (CH); Michael Matheisl, Vösendorf (AT); Walter Thierer, Vienna (AT); Wolfgang Klein, Neusiedl am See (AT); Richard Schütz, Vienna (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 16/312,857

(22) PCT Filed: Jun. 21, 2017

(86) PCT No.: PCT/EP2017/065230
§ 371 (c)(1),
(2) Date: Dec. 21, 2018

(87) PCT Pub. No.: WO2017/220650
PCT Pub. Date: Dec. 28, 2017

(65) Prior Publication Data

US 2019/0322492 A1 Oct. 24, 2019

(30) Foreign Application Priority Data

Jun. 21, 2016 (EP) ..... 16175491

(51) Int. Cl.
*B66B 21/02* (2006.01)
*B66B 23/14* (2006.01)
*B66B 21/10* (2006.01)

(52) U.S. Cl.
CPC ..... *B66B 21/02* (2013.01); *B66B 21/10* (2013.01); *B66B 23/14* (2013.01)

(58) Field of Classification Search
CPC ..... B66B 23/14; B66B 21/02; B66B 21/00; B66B 19/007; B66B 21/10
See application file for complete search history.

(56) References Cited

U.S. PATENT DOCUMENTS 9,988,244 B2 * 6/2018 Makovec ..... B66B 21/10
2012/0168277 A1 7/2012 Senger et al.
(Continued)

FOREIGN PATENT DOCUMENTS

EP 2527283 11/2012
WO WO 2004/035452 4/2004

OTHER PUBLICATIONS

International Search Report for International Application No. PCT/EP2017/065230 dated Jul. 28, 2017.

*Primary Examiner* — Mark A Deuble
(74) *Attorney, Agent, or Firm* — Knobbe Martens Olson & Bear LLP

(57) ABSTRACT

The application relates to a method for modernizing an existing escalator or an existing moving walkway. The method can include removing all the electrical and mechanical parts from the existing framework of the existing escalator or of the existing moving walkway, the existing framework having two framework side parts and a base structure connecting said framework side parts, and the framework side parts being connected to each other by means of cross members disposed at a distance from the base structure; and replacing the existing cross members of the existing framework with new cross members, the two framework side parts of the existing framework being connected to each other in a mutually stabilising manner at least one point at a distance from the base structure of the framework, during replacement of the cross members.

13 Claims, 4 Drawing Sheets

(56) References Cited

U.S. PATENT DOCUMENTS

| | | | | |
|---|---|---|---|---|
| 2012/0298480 | A1 | 11/2012 | Casielles et al. | |
| 2016/0200552 | A1* | 7/2016 | Sullivan | B66B 21/00 52/741.1 |
| 2016/0376128 | A1* | 12/2016 | Gonzalez Pantiga | B66B 23/00 198/321 |
| 2018/0118521 | A1* | 5/2018 | Matheisl | B66B 23/14 |
| 2018/0319631 | A1* | 11/2018 | Illedits | B65G 21/02 |

* cited by examiner

Fig. 4
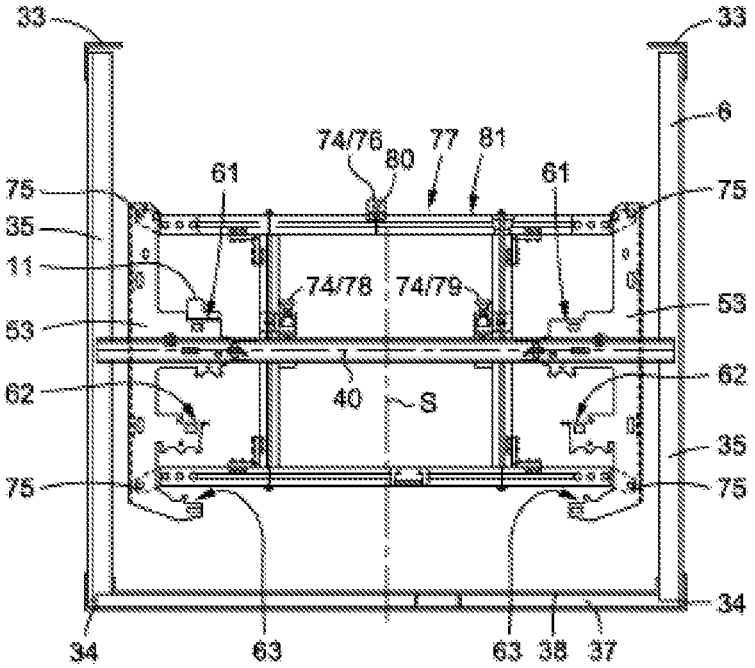
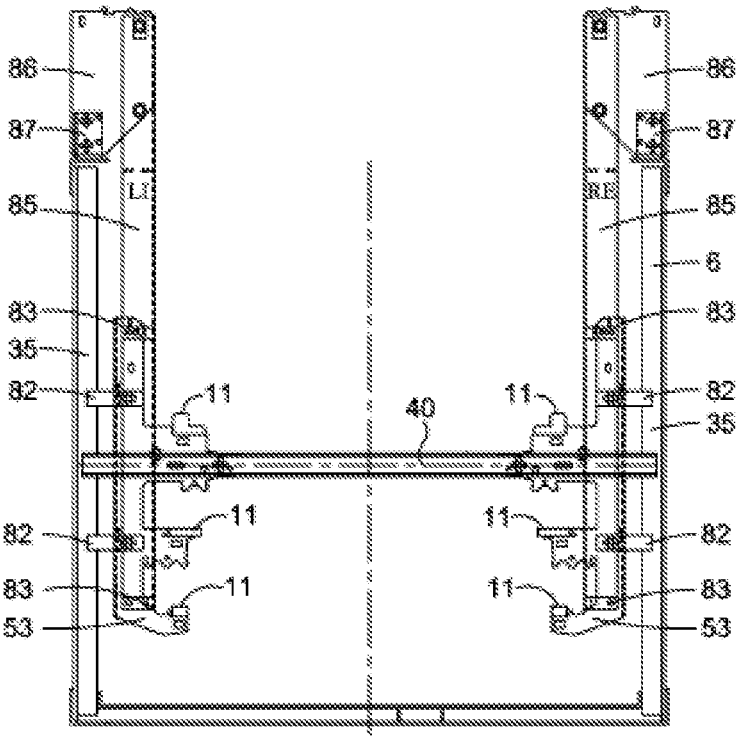
Fig. 5

METHOD FOR MODERNIZING AN ESCALATOR OR A MOVING WALKWAY

TECHNICAL FIELD

The invention relates to a method for modernizing an existing escalator or an existing moving walkway.

SUMMARY

Escalators and moving walkways are widespread and are installed in many types of buildings, including commercially used buildings, in public transport stations, and in airports. The escalators and moving walkways are used to move passengers quickly and efficiently from one story to another. Escalators and moving walkways often remain in use for years, even for decades in many cases if they are well maintained. Often, the escalator or the moving walkway is produced at the same time as the building and installed in said building during the construction phase thereof. In this case, most escalators and moving walkways are not provided simply as predefined mass-produced goods, but rather are individually adapted to the requirements of the developer and building users with regard to the design of the building. However, as with all mechanical apparatuses, in particular the moving parts of the escalator or of the moving walkway wear out over time and must be replaced. Furthermore, official regulations, such as the Euronorm EN 115, also change.

If required, repairs can be carried out by replacing individual parts. Replacing individual parts or repairing said parts cannot bring the escalator or the moving walkway as a whole to the latest technical and safety standards. The overall effectiveness of the repaired escalator is hardly changed either. In order to have an escalator or a moving walkway that is in line with the most recent prior art in the existing building, said escalators and moving walkways are typically completely dismantled and removed and replaced by a new escalator or a new moving walkway. This is very expensive and time-consuming, as complete replacement often requires the creation of large openings in the existing building so that the new escalator or the new moving walkway can be introduced into the building. Another problem is that current norms, for example with regard to earthquake resistance, apply to new escalators. This may lead to the new escalator no longer fitting into the available pits of the old escalator and said pits needing to be enlarged at great expense.

It has proven to be highly advantageous to clear the existing escalator down to the framework and to adapt the existing framework thereof to the escalator parts to be newly inserted. A method of this kind for modernizing an existing escalator is disclosed in WO 2004/035452 A1 and in EP 2 527 283 A1. According to this method, the existing escalator is gutted to the extent that only the existing framework remains. In this method, modules are aligned on the existing cross members and fastened, such that the new escalator components can be installed in the existing framework. As the existing frameworks of the individual manufacturers have very different designs, the modules and components to be inserted must be adapted to the existing framework on an order-specific basis. This leads to high engineering effort and reduces the attractiveness of the modernizing method due to the high labor costs.

An object of the present invention consists in specifying a simplified method for modernizing an existing escalator or an existing moving walkway.

This object is achieved by a method for modernizing an existing escalator or an existing moving walkway. Said method comprises the following steps:

removing all the electrical and mechanical parts from the existing framework of the existing escalator or of the existing moving walkway, the existing framework having two framework side parts and a base structure connecting said framework side parts, and the framework side parts being connected to each other by means of cross members disposed at a distance from the base structure, and removing all the existing cross members of the existing framework and replacing at least part of the removed existing cross members with new cross members to which the new components to be installed of the escalator or of the moving walkway are matched, the two framework side parts of the existing framework being connected to each other in a mutually stabilizing manner at least one point at a distance from the base structure of the framework, during replacement of the cross members.

The above-described method eliminates the main cause of the necessary extensive adaptation work on components to be newly inserted. This work is caused in particular by the existing cross members, which are disposed typically between the forward motion and the backward motion of the circulating conveyor band (step band in escalators, palette band in moving walkways). The existing cross members can have very different dimensions depending on the manufacturer, and therefore influence the distance between the rails of the forward motion and the backward motion. However, the new cross members to be inserted are ideally matched to the components to be newly inserted, so that the new components such as rails, rail supports or frames, deflecting modules, clamping slides and the like no longer need to be adapted to the dimensions and the position of the existing cross members in the existing framework.

The framework side parts of most existing frameworks are, with the exception of the cross members and the end face by means of the support brackets, connected to each other only by a base structure and therefore form a receiving structure that has a U-shaped cross section and opens upwards for the additional components of the escalator or of the moving walkway.

The specific obstacle to removing existing cross members is that the existing cross members cannot be easily cut out of the existing framework, as said cross members support the two framework side parts of the existing framework mounted in the building and therefore provide the existing framework with high rigidity and stability. As the existing framework is mounted in the building only at the two end faces thereof, similarly to a bridge, even when the modernization method is being carried out, dangerous situations must be prevented. The two end faces are the regions at which the support brackets as the interface of the framework to the building are disposed. The access regions are also disposed there, by means of which the users can enter and leave an escalator or a moving walkway. In the case of particularly long escalators and moving walkways, the framework can also be supported between the two end faces by means of intermediate bearings. However, this is not sufficient to keep the framework rigid and stable if there are cross members missing.

The structure of the framework is designed for the rigidity and sustainability of the vertical framework side parts thereof. Due to the net weight of the framework and forces acting on the framework, such as point loads, tremors, vibrations and the like, there is the risk that the framework side parts could incline to the side due to a lack of cross members and the framework could then collapse or at least plastically deform. A collapsed or deformed framework is completely unusable and could not even be repaired or straightened.

A dimensionally stable and rigid framework is also an advantage that is not to be underestimated when the modernization method is carried out. The emptied framework may be used as an assembly platform only when the safety of the assembly personnel is ensured. When the dimensional stability thereof is ensured, material on the existing framework can be safely transported to its installation location.

In one variant of the method, the cross members are sequentially replaced in order to stabilize the two framework side parts. As the operation proceeds, the framework side parts are connected to each other in a mutually stabilizing manner decreasingly by means of existing cross members and increasingly by new cross members, due to the sequential replacement, the new cross members being at a distance from the base structure and being disposed in the framework so as to connect the two framework side parts.

Preferably, in the case of sequential replacement, one cross member is replaced after the other in each case. Depending on the inherent stability of the framework side parts, two or more cross members may be replaced at the same time. Another possibility is that each second existing cross member is first removed and, after it has been removed, the free points are each provided with a new cross member. Subsequently, the remaining existing cross members are removed and the free points are then provided with new cross members.

In another variant of the method, at least one stabilizing apparatus for stabilizing the two framework side parts is fastened to the existing framework before the existing cross members are removed. This apparatus connects the framework side parts in a mutually stabilizing manner at one point at a distance from the base structure of the existing framework. After the at least one stabilizing apparatus is fastened, the existing cross members can be removed and new cross members can then be inserted. After the new cross members are inserted, the at least one stabilizing apparatus is removed.

A simple stabilizing member, for example, may be fastened to the framework side parts as a stabilizing apparatus. This stabilizing member can be fastened to the framework side parts preferably with detachable connecting elements such as clamping jaws, screws, socket pins, cotter bolts and the like. In this case, it is sufficient if said member supports the framework side parts against each other; the stabilizing member does not have to be able to transmit large forces. However, the stabilizing member must be resistant to both tensile stress and to pressure, i.e., it can withstand the maximum tensile forces and compressive forces occurring at its fastening point without tearing or buckling.

Preferably, the position of the new cross members in the existing framework is determined from the installation space required for the modernizing components to be newly inserted and in relation to the height of the framework side parts. This can ensure that there is sufficient space between the new cross member and the base structure for the new components to be inserted, in particular for the backward motion of the step band or palette band. However, the new cross members should not be disposed between the framework side parts at too great a distance from the base structure, so that it is not necessary to make too many adaptations to the new balustrade bases, the position of which also depends on the position of the step band or palette band in the framework.

In order to make the work for the assembly personnel in charge of modernization easier, the position of the new cross members is preferably established as the distance from the top chords of the existing framework side parts towards the bottom chords of the existing framework side parts as a positioning instruction. When the cross members are inserted, it is sufficient to simply measure and mark the distance, for example, on framework webs of the existing framework side parts. These framework webs connect the top chord thereof to the bottom chord thereof. Subsequently, the new cross member can be clamped firmly to the framework webs with screw clamps and can then be welded, riveted or screwed to said webs. The cross members should be aligned as horizontally as possible. Highly precise alignment of the cross members, for example by means of a spirit level, is not necessarily required, however, as precise alignment occurs only when frames are inserted.

Typically, the existing cross members are welded on a first lateral surface of framework webs of the framework side parts. The existing cross members can be removed quickly and easily, by simply being sawn through on both sides and near the framework web. As a result, a small piece of the existing cross member remains on each framework side part or on the framework web. In order that this piece does not have to be removed in a cumbersome manner, the new cross member can be fastened to a second lateral surface of the framework web.

In a further step, a first deflecting module having rail interfaces can be installed in the framework provided with new cross members at a first end of the framework and a second deflecting module having rail interfaces can be installed in the framework at a second end of the framework. The term "ends of the framework" can refer to the two end faces of the framework, which typically each have a support bracket by means of which the framework is supported in the building. The correct positions of the two deflecting modules are established depending on a level adjacent to the framework, for example the floor of a story of a building and at the position of the new cross members in the existing framework.

The deflecting modules, often referred to as rail blocks, contain all the relevant components for deflecting a step band or palette band from its forward motion to its backward motion. These are, for example, deflecting guide rails having rail interfaces. The first deflecting module further comprises a clamping slide having a deflecting shaft that is provided with deflecting sprockets. The second deflecting module comprises, as well as the rail interfaces, a drive shaft having drive sprockets, and optionally a drive motor having a gear mechanism for driving the drive shaft.

Frames are fastened in the framework between the deflecting modules, which frames have fastening points for rails or tracks. In order to be able to ensure smooth, straight movement of the step band or palette band, the rails must be aligned exactly with the rail interfaces. This occurs particularly precisely when an alignment device is disposed at the rail interfaces of the first deflecting module and a target device is disposed at the rail interfaces of the second deflecting module. The alignment device comprises an alignment means, preferably a laser beam. Of course, another alignment means, for example a tensioned cable, a tensioned cord or a tensioned wire, may be used, it being necessary to take into account sagging due to the net weight thereof when said means is used. The alignment means is adjusted to a target device. Additional components to be inserted into the framework between the deflecting modules, such as the frames to be inserted, can be aligned on this alignment means.

In the case of assembling frames, a frame assembly apparatus or a frame assembly jig is preferably available. This frame assembly apparatus is first provided with a right-hand frame and a left-hand frame at provided receptacles. The frame assembly apparatus is then placed onto a new cross member and the frame assembly apparatus is then aligned on the alignment means of the alignment device with the separate adjustment device. The frames held in alignment by the frame assembly apparatus are then fastened to the new cross member. Finally, the frame assembly apparatus is removed from the new cross member provided with frames.

The new cross members may be designed such that they specifically have a stabilizing effect. In this case, the frames can be fastened additionally or only on the framework side parts, for example, with connecting links that are welded between the framework webs and the frames. Cross members of this kind, in particular stabilizing cross members, can have very small dimensions with regard to their cross section and permit very slim constructions that fit into any existing framework.

The framework provided with new cross members, frames and deflecting modules can then be completed with new rails, drive components, control components, with a new step band or palette band, with cladding parts, balustrades and handrails, to form a modernized escalator or a modernized moving walkway.

A set of devices is preferably provided for carrying out the above-described modernizing method of an existing escalator or of an existing moving walkway. This set comprises

- at least one alignment device, which comprises support points that can be aligned with rail interfaces of deflecting modules,
- at least one target device, which comprises support points that can be aligned with rail interfaces of deflecting modules, the alignment device being adjustable to the target device when installed, and
- at least one frame assembly apparatus matched to the new cross member, which comprises an adjustment device and at least one receptacle for at least one frame.

The adjustment device of the frame assembly apparatus may comprise two mutually distally disposed setting devices, which are supported on the new cross member for the purposes of adjusting the assembly apparatus. The adjustment device further contains an alignment aperture having a hole or a notch having a groove. The diameter of the hole or the cross section of the groove are matched to the alignment means. If, for example, a laser beam of the alignment device is used as the alignment means, an alignment aperture having a hole is preferably used that has the beam cross section of the laser beam. If a wire is used as the alignment means, a notch having a groove is provided instead, the cross section of which is matched to the wire cross section.

It has been described above that first the new cross members and then the frames are constructed. Of course, the cross members and the frames may be inserted together using the method according to the invention. In this case, the new cross member, which is installed in an existing framework as a replacement for an existing cross member, is already provided with the frames. Preferably, frame-like formations are formed on the new cross members. Particularly preferably, the new cross member is cut in one piece from a metal sheet, the new cross member comprising a C-shaped central portion formed by folded edges and at least two frame portions integrally formed on the central portion. At least fastening points for rails of the escalator or of the moving walkway are formed on these frame portions.

However, in this case it is not sufficient to weld this new cross member on framework webs in a simple rough alignment, as the frames are already integrally formed on the new cross members and therefore the possibility of aligning the frames with the rail interfaces is no longer available. When new cross members of this kind are used, the deflecting modules are therefore installed in the framework first. As already described, the alignment device and the target device are disposed on the rail interfaces. The new cross members of the type mentioned above are then aligned on alignment means. For this purpose, an alignment aperture or a notch having a groove may be temporarily fastened to the new cross member.

It is particularly advantageous if at least one alignment aperture having a hole or a notch having a groove is formed on the above-mentioned new cross member. This is possible without any problems, as said cross member is produced from a metal sheet preferably by means of laser cutting methods or CNC punching methods and the alignment aperture or notch can be cut out at the same time. The diameter of the hole or the cross section of the groove are matched to the alignment means of the alignment device.

BRIEF DESCRIPTION OF THE DRAWINGS

The method for modernizing an existing escalator or an existing moving walkway and other features of this application are described in the following with reference to examples and to the drawings, the same reference signs being used for the same components in all the drawings. In the drawings:

FIG. 4 shows an example of a frame assembly apparatus, as used during installation of the frames in FIG. 3;

FIG. 5 shows an example of a balustrade base assembling apparatus, which is supported on the installed frames shown in FIG. 4;

DETAILED DESCRIPTION

Figure 1:
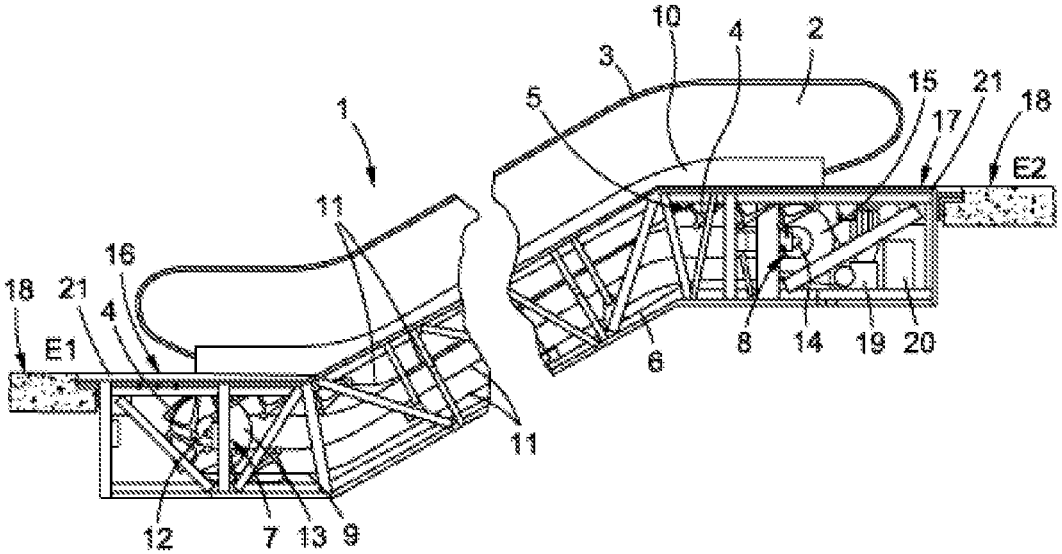
FIG. 1 is a schematic side view of an existing escalator before modernization, comprising balustrades, comprising a framework and two deflecting regions, rails being disposed in the framework and a circulating step band being disposed between the deflecting regions.

FIG. 1 is a schematic side view of an existing escalator 1, which connects a first story E1 to a second story E2. In order that the most significant components thereof can be shown, the escalator 1 is shown in FIG. 1 without side cladding. The escalator 1 comprises a framework 6 having two deflecting regions 7, 8, between which a step band 5 (shown only in part) is guided in a circulating manner. The step band 5 comprises traction means 9 on which steps 4 are disposed. Furthermore, schematically shown rails 11 are disposed in the framework 6, which rails extend between the two deflecting regions 7, 8 and guide the step band 5 in the forward motion and in the backward motion. A deflecting shaft 12 having deflecting sprockets 13 (only one of which is visible) is rotatably mounted in the deflecting region 7 of the first story E1. A deflection spindle 14 having drive sprockets 15 (only one of which is visible) is disposed in the deflecting region 8 of the second story E2, which sprockets are driven by a drive 19. The step band 5 is guided around the sprockets 13, 15 in the two deflecting regions 7, 8. The drive 19 is controlled with a control means 20.

Furthermore, a handrail 3 is disposed on a balustrade 2. The lower end of the balustrade 2 is connected to the framework 6 by means of a balustrade base 10. The escalator 1 or the step band 5 thereof can be entered via access regions 16, 17 at each end of the escalator 1. The accessible surfaces of the access regions 16, 17 are floor coverings 21, each of which close the opening to the underfloor deflecting region 7, 8 of the escalator 1 in a flush or even manner to the surrounding accessible floor 18 of the stories E1, E2.

Of course, an existing moving walkway 1 may be present instead of the existing escalator 1, a pallet band being disposed in a circulating manner instead of a step band 5. Furthermore, the central part of a moving walkway disposed between the deflecting regions does not have an incline or has only a low incline of up to 12%.

As escalators 1 and moving walkways typically remain in use for many years, there comes a time when they are technically outdated and it becomes more expensive to produce replacement parts, as the required replacement parts can be reproduced in only small quantities. In addition, buildings are adapted and rebuilt according to the changed requirements for use at intervals of decades. Typically, in the course of this renovation work, the owner would also like the escalator 1 or the moving walkway to have a new, up-to-date appearance. The only component of an escalator 1 or a moving walkway that has not experienced any significant technical development over many decades is the framework 6.

The framework 6 is also the component of an escalator 1 or a moving walkway 1 that requires the most outlay, due to its dimensions and its high weight. It is therefore expensive to transport said framework, and it may be necessary to demolish walls in existing buildings at least in part and create large openings in the building shell, in order to introduce the new escalator 1 into the existing building. It is therefore possible to continue using the existing framework 6.

First, therefore, the existing escalator 1 or the existing moving walkway 1 must be dismantled, with the exception of the existing framework 6. When the existing components of the escalator 1 or the existing moving walkway 1 are dismantled, the existing framework 6 is used ideally as scaffolding between the two stories E1 and E2.

Figure 2:
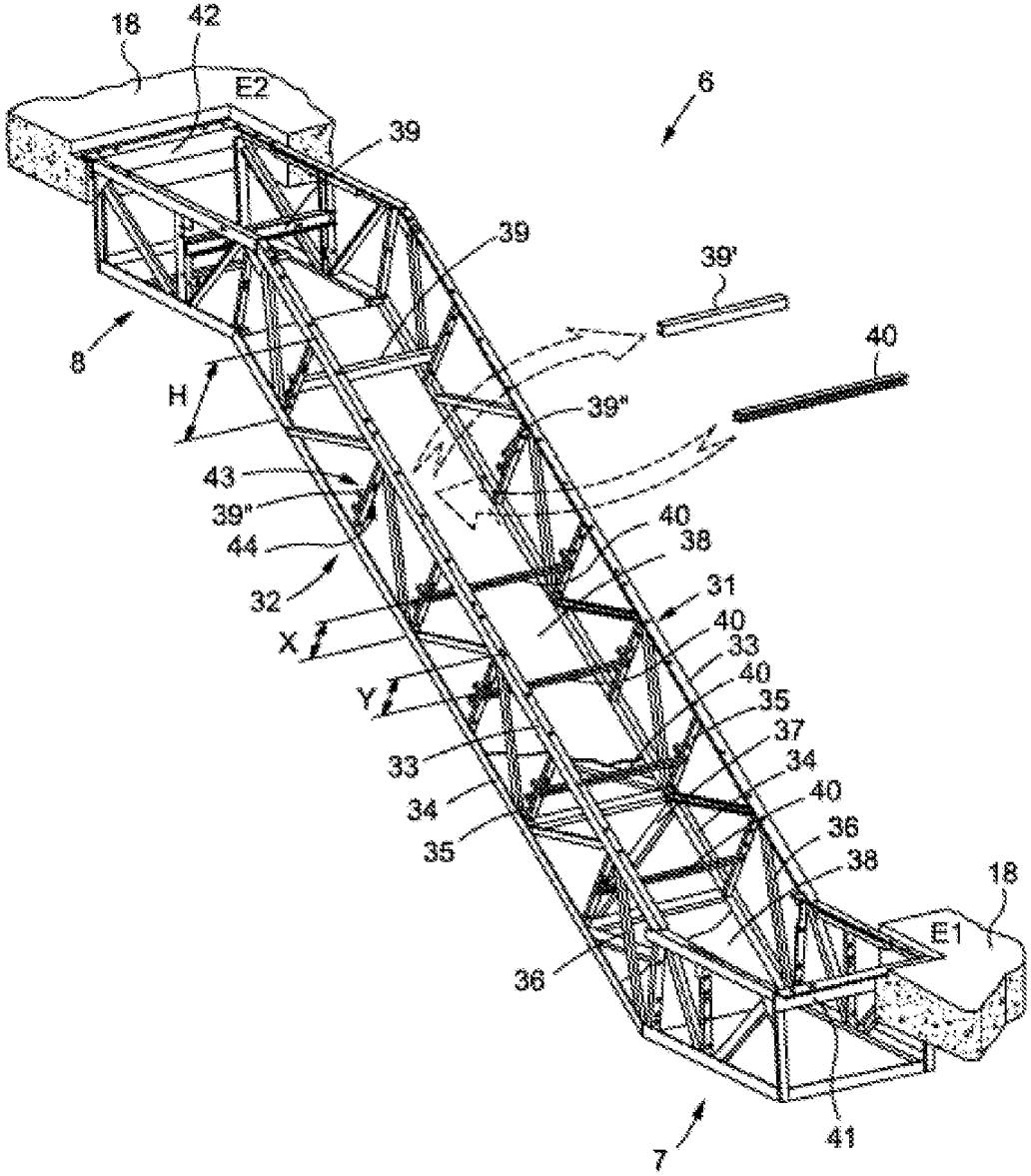
FIG. 2 is a three-dimensional view of the emptied existing framework of FIG. 1 during a method step in a first embodiment, in which existing cross members are replaced sequentially by new cross members.

FIG. 2 is a three-dimensional view of the emptied existing framework 6 from FIG. 1. The existing framework 6 comprises two parallel framework side parts 31, 32, which are constructed substantially of top chords 33, bottom chords 34 and framework webs 35 and diagonal members 36. The framework side parts 31, 32 are connected to each other at the bottom chords 34 thereof by means of a base structure 37. The base structure 37 is covered by welded metal sheets 38. In order to make the base structure 37 visible, a region without covering metal sheets 38 has been shown. These metal sheets 38, also known as oil sheets, are used to collect lubricants and dirt.

Before the method is carried out, the framework side parts 31, 32 are connected to each other, with existing cross members 39, at points that are at a distance from the base structure 37. The existing cross members 39 mutually support the two framework side parts 31, 32 of the existing framework 6 that is mounted in the floors 18 of the stories E1, E2 and thereby provide the existing framework 6 with high rigidity and stability. The dimensions and the position of the existing cross members 39 in the framework 6 are matched to the components of the existing escalator 1 that have already been removed. As the existing framework 6 is still mounted in the building at the two ends faces 41, 42 thereof, similarly to a bridge, the existing framework 6 would become highly unstable if the existing cross members 39 were simply removed.

After the existing framework 6 is emptied, it is preferably cleaned. The existing cross members 39 are then replaced with new cross members 40, which are adapted to the parts of the modernized escalator 1 to be newly installed. This can be carried out, for example, in a first embodiment of the proposed method for modernizing an existing escalator 1 or an existing moving walkway, in which existing cross members 39 are sequentially replaced with new cross members 40. At this point, it should be noted that not necessarily all the existing cross members 39 are replaced with new cross members 40, as it may be the case that existing cross members 39 in the deflecting regions 7, 8 need to be removed in order to create sufficient space for the deflecting modules 51, 52 (see FIG. 3) to be inserted there, which modules connect the two framework side parts 31, 32 in a mutually stabilizing manner in these regions.

When the method according to the invention is carried out, the position of the new cross members 40 in the existing framework 6 may first be determined, for example. This position is dependent on the installation space required for the modernization components to be newly inserted and in relation to the height H of the framework side parts 31, 32. This can ensure that there is sufficient passage height X between the new cross members 40 and the base structure 37 for the new components to be inserted, in particular for the backward motion of the step band 5 or palette band. However, the new cross members 40 should not be disposed between the framework side parts 31, 32 at too great a distance from the base structure 37, so that it is not necessary to make too many adaptations to the new balustrade base (see FIG. 5), the position of which also depends on the position of the step band 5 or palette band in the framework 6.

As soon as the position Y=H−X of the new cross members 40 has been determined, replacement of the cross members can begin. In the case of sequential replacement, an existing cross member 39 can be separated out, as shown. Typically, the existing cross members 39 are welded on a first lateral surface 43 of the framework web 35. The existing cross members 39 can be removed quickly and easily, by simply being sawn through on both sides and near the framework web 35. As a result, a small piece 39" of the now separated existing cross member 39' remains on each framework side part 31, 32 or on the framework web 35. In order that this piece 39" does not have to be removed in a cumbersome manner, the new cross member 40 can be fastened, at the previously determined position, to a second lateral surface 44 of the framework web 35.

Of course, the existing cross member can also be fully removed and the new cross member 40 can be fastened to this lateral face 43 of the framework web 35. The new cross members 40 are fastened in a form-fitting manner by riveting, screwing, clinching or integrally by means of bonding, soldering or welding. The next existing cross member 39 is then replaced by a new cross member 40 in the same way. In the case of this sequential process, the existing framework 6 can be worked through from the first story E1 to the second story E2, for example.

Of course, another sequence of cross member replacement is possible. If the inherent stability of the existing framework 5 allows it, a plurality of existing cross members 39 can be replaced with new cross members 40 at the same time, for example two cross members in each case.

Another possibility for sequential replacement is that each second existing cross member 39 is first removed and, after it has been removed, the free points are each provided with new cross members 40. Subsequently, the second group of existing cross members 39 is separated out and new cross members 40 are installed at these points. Or, in the case of particularly sturdy existing frameworks, even more existing cross members may be separated out at the same time and replace with new cross members. The only condition for sequential replacement is that the two framework side parts 31, 32 of the existing framework 6 are connected to each other in a mutually stabilizing manner at least one point by means of an existing cross member 39 or a new cross member 40, during replacement.

Figure 3:
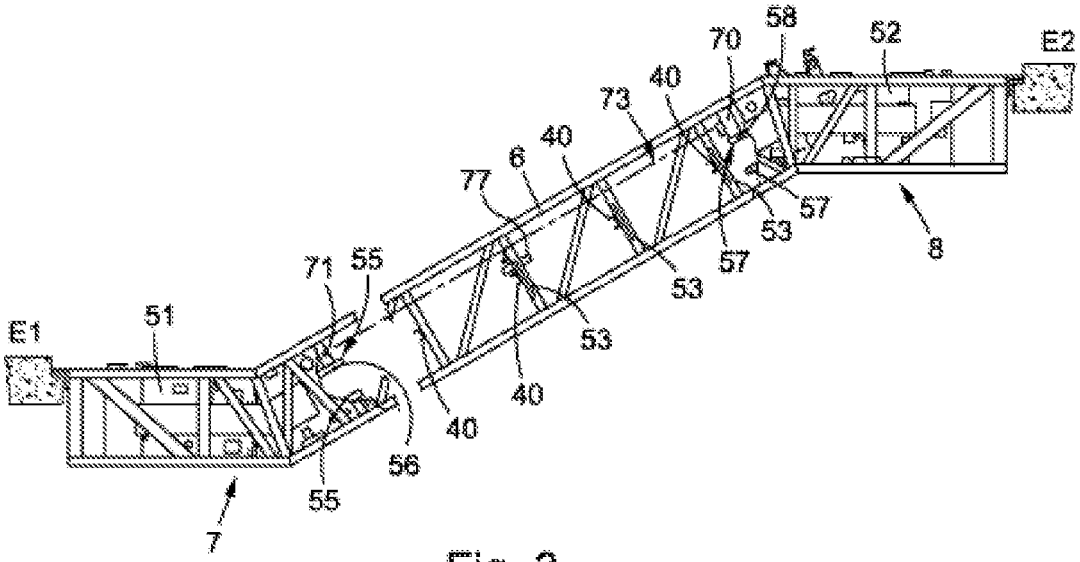
FIG. 3 is a partially sectional side view of the existing framework of FIG. 2 provided with new cross members and deflecting modules during installation of the frames.

FIG. 3 is a partially sectional side view of the existing framework 6 of FIG. 2 provided with new cross members 40 and deflecting modules 51, 52 during installation of the frames 53.

The deflecting modules 51, 52 are pre-assembled units which are constructed according to their function. For example, the first deflecting module 51 disposed in the first story E1 comprises the deflecting sprockets having a tensioning device (not visible) for the step band. Furthermore, rail portions 55 having rail interfaces 56 are disposed in the first deflecting module 51. The second deflecting module 52 disposed in the second story E2 may comprise the drive sprockets and various drive components (not visible) such as a drive motor and a gear mechanism. Rail portions 57 having rail interfaces 58 are also disposed in the second deflecting module 52.

The frames 53 are components to be rigidly connected to the existing framework 6, on which components fastening regions 61, 62, 63 for rails 11 (see FIG. 4) are formed. In order that the rails 11 can be installed as easily as possible, the frames 53 or the fastening regions 61, 62, 63 thereof for the rails 11 are to be aligned exactly with the rail interfaces 56, 58 of the deflecting modules 51, 52.

A set of devices is therefore preferably available for installing the frames 53. This set comprises:

- at least one alignment device 70 having support points that can be aligned with rail interfaces 56, 58 of deflecting modules 51, 52 (see FIG. 3),
- at least one target device 71 having support points that can be aligned with rail interfaces 56, 58 of deflecting modules 51, 52, the alignment device 70 being adjustable to the target device 71 when installed (see FIG. 3), and
- at least one frame assembly apparatus 77 which is matched to the new cross member 40 and has an adjustment device 74 and at least one receptacle 75 for at least one frame 53 (see FIG. 4).

As shown in FIG. 3, the target device 71 is disposed on the rail interfaces 56 of the first deflecting module 51. The alignment device 70 is disposed on the rail interfaces 58 of the second deflecting module 52. A dot-dash line, which represents the alignment means 73, is shown between the target device 71 and the alignment device 70. According to the course of the alignment means 73 shown in FIG. 3, the alignment device 70 is already adjusted to the target device 71. This alignment means 73 may be a tensioned wire or a plumb line; however, a laser beam is preferably used as the alignment means 73.

FIG. 3 shows several frames 53 that are already assembled. A set of frames 53 is held in the correct installation position by means of the frame assembly apparatus 77 supported on a new cross member 40.

Adjustment of the correct installation position can be seen in FIG. 4. This drawing shows, by way of example, a frame assembly apparatus 77, as used during installation of the frames 53 in FIG. 3. The frame assembly apparatus 77 comprises four recesses 75 in the form of receiving mandrels 75. A frame 53 can be inserted into two of these four receptacles 75 in each case. The two frames 53 are to be disposed mirror-symmetrically to a mid-perpendicular plane S of the frame assembly apparatus 77.

Furthermore, the frame assembly apparatus comprises an adjustment device 74. This adjustment device contains a left-hand adjusting device 78, a right-hand adjusting device 79 and an alignment aperture 76. The setting devices 78, 79 and the alignment aperture 76 form, due to their arrangement on the frame assembly apparatus 77, a triangle, the base of this triangle being provided by the new cross member 40, on which the two setting devices 78, 79 are supported. Adjusting screws 78, 79 can be used as simple adjusting devices 78, 79, for example.

In order to align the frames 53 in the existing framework 6, the setting devices 78, 79 are actuated and the frame assembly apparatus 77 is moved on the new cross member 40 until the alignment means 73, for example a laser beam 73, passes through a hole 80 of the alignment aperture 76. In this case, a horizontal portion 81 of the frame assembly apparatus 77 should be precisely horizontally aligned. Of course, the alignment device 70 may also comprise two mutually parallel alignment means 73 and the frame assembly apparatus 77 may comprise two alignment apertures 76. This makes it substantially easier to horizontally align the frame assembly apparatus 77.

The indicated rail profile of a rail 11 shows that the arrangement of the frames 53 in the existing framework 6 must be extremely precise. Said profile rests directly on the fastening region 61 of the frame 53. In the present embodiment of FIG. 4, the frames 53 are fastened to the new cross members 40. Of course, the frames 53 may also be fastened to the framework webs 35, as implemented in FIG. 5 by links 82. Particularly secure and stable fastening is produced when the frames 53 are rigidly connected to both the new cross members 40 and the framework webs 35. The frames 53 can be fastened by screws, rivets, pins, bolts or by means of welding, soldering, bonding and the like.

Furthermore, the cross section of the framework 6 can be seen in FIGS. 4 and 5, in particular the arrangement of the webs 35, of the top chords 33, of the bottom chords 34, of the base structure 37, of the new cross member 40 and of the oil sheet 38.

In FIG. 5, the rails 11 are already assembled on the frames 53 and the frame assembly apparatus 77 shown in FIG. 4 has been removed. The holes 83 on the frames 53, by means of which holes the frames 53 were disposed on the receiving mandrels 75 of the frame assembly apparatus 77, are therefore also free. These holes 83 can therefore be used as receiving points for a balustrade base assembly apparatus 85, as shown in FIG. 5. The balustrade base assembly apparatus 85 holds base frames 86 in the correct position precisely aligned with the rails 11, such that the welding straps 87 thereof are aligned to the existing framework 6 and can be welded thereon.

Figure 6:
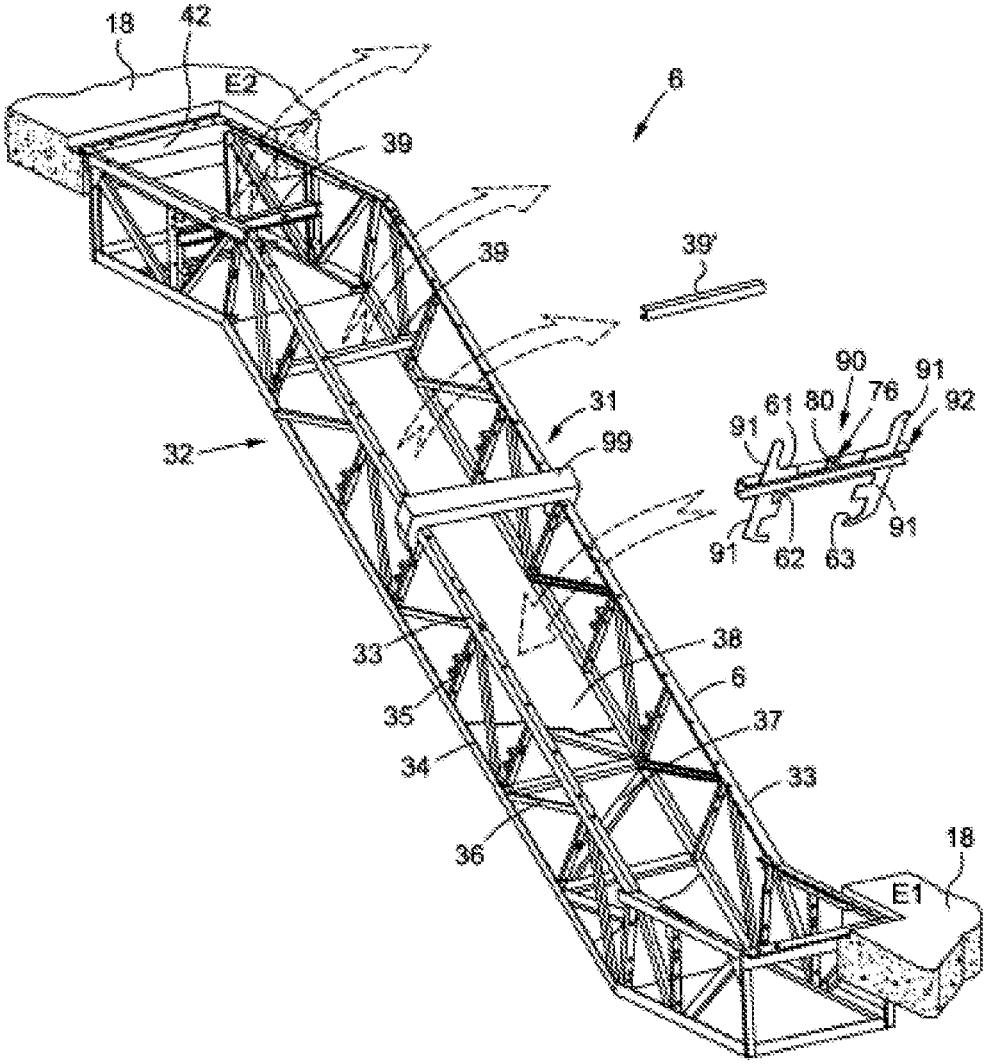
FIG. 6 is a three-dimensional view of the emptied existing framework of FIG. 1 during a method step in a second embodiment, in which existing cross members are replaced with new cross members having integrally formed frame portions by means of a stabilizing apparatus.

FIG. 6 is a three-dimensional view of the emptied existing framework 6 from FIG. 1. As already described in FIG. 2, the existing framework 6 comprises two mutually parallel framework side parts 31, 32, which are constructed substantially from top chords 33, bottom chords 34 and the framework webs 35 and diagonal members 36 connecting these chords. The framework side parts 31, 32 are connected to each other at the bottom chords 34 thereof by means of a base structure 37. The base structure 37 is covered by welded metal sheets 38.

After the existing framework 6 is emptied, it is preferably cleaned. Subsequently, the existing cross members 39 are replaced with new cross members 90, which are adapted to the parts to be newly installed of the modernized escalator.

This replacement can also be carried out, for example, in a second embodiment of the proposed method for modernizing an existing escalator 1 or an existing moving walkway, in which existing cross members 39 are replaced with new cross members 90 by means of a stabilizing apparatus 99. In principle, this method can also be carried out using the cross members 40 shown in FIGS. 2 to 5. The cross member 90 shown in FIG. 6 also comprises integrally formed frame portions 91.

In the embodiment in FIG. 6, a stabilizing apparatus 99 is fastened in the center of the existing framework 6 by means of detachable connecting elements (not shown), in order to stabilize the two framework side parts 31, 32. The stabilizing apparatus 99 is fastened before the existing cross members 39 are removed. The stabilizing apparatus 99 connects the framework side parts 31, 32 in a mutually stabilizing manner at one point at a distance from the base structure 37 of the existing framework 6. After the stabilizing apparatus 99 is fastened, all the existing cross members 39 can be removed and new cross members 90 can then be inserted into the framework 6. The stabilizing apparatus 99 is then removed. Of course, if one stabilizing apparatus 99 is not sufficient, a plurality of stabilizing apparatuses 99 can be used and fastened at predetermined distances from one another, for example between the top chords 33.

A simple stabilizing member 99 can be inserted between the framework side parts 31, 32 as the stabilizing member 99, for example. This stabilizing member can be fastened to the framework side parts 31, 32 preferably by means of detachable connecting elements such as clamping jaws, screws, socket pins, cotter bolts and the like. In this case, it is sufficient if these connecting elements support the framework side parts 31, 32 against each other; the stabilizing apparatus 99 does not have to be able to transmit large forces.

As shown in FIG. 6 by way of example, the new cross member 90, which is installed in a framework 6 as a replacement for an existing cross member 39, is already provided with the frames or with frame portions 91. The frame-like formations are integrally formed on the new cross members 90. This new cross member 90 can, for example, be cut out of a flat metal sheet by means of a laser cutting method or a water jet cutting method. Subsequently, a C-shaped central portion 92 can be produced on the new cross members 90 folded edges. This production creates a new cross member, which comprises frame portions 91 integrally connected to each other by means of the central portion 92. At least fastening points 61, 62, 63 for rails 11 of the escalator 1 or of the moving walkway are formed on the frame portions 91.

When the above-described new cross member 90 having frame portions 91 or the new cross member 40 provided with frames 53 is installed, it is not sufficient, however, to weld it in a simple rough alignment on framework webs 35, as the frames are already integrally formed or fastened on the new cross member 90 and therefore the possibility of aligning the fastening points 61, 62, 63 with the rail interfaces 56, 58 (see also FIG. 3) is no longer available. When new cross members 90 of this kind are used, the deflecting modules 51 are therefore preferably installed in the existing framework 6 first. As already described, the alignment device 70 and the target device 71 are disposed on the rail interfaces 56, 58. The new cross members 90 of the type mentioned above can then be aligned on the alignment means 73. For this purpose, an alignment aperture 76 or a notch having a groove may be temporarily fastened to the new cross member 90.

It is particularly advantageous if at least one alignment aperture 76 having a hole 80 or a notch having a groove is formed on the above-mentioned, integral new cross member 90. This is possible without any problems, as said cross member is produced from a metal sheet preferably by means of laser cutting methods and the alignment aperture 76 or notch can be cut out at the same time. The diameter of the hole 80 or the cross section of the groove are matched to the alignment means 73, described in connection with FIG. 3, of the alignment device 70.

In connection with FIGS. 3 to 5, it was described that first the new cross members 40 and then the frames 53 are installed. Of course, the cross members 40 and the frames 53 may be inserted together using the method according to the invention. For this purpose, the frames 53 must be assembled on the new cross member 40 before the new cross member 40 is installed in the existing framework 6. In accordance with the previous embodiment, an alignment aperture 76 or a notch having a groove must be temporarily fastened on the new cross member 40 provided with frames 53 in this case, too.

Although the invention has been described by presenting specific embodiments, it is obvious that numerous other embodiments can be produced with regard to the present invention, for example by a stabilizing apparatus 99 also being used in sequential replacement. Furthermore, the order in which the existing cross members 39 are first replaced with new cross members 40, 90 and then the deflecting modules 51, 52 are installed, or vice versa, is irrelevant. Of course, the adjustment device 74 of the frame assembly apparatus 77 may also comprise completely differently designed setting devices 78, 79, for example having wedges. In addition, an adjustment device 74 that can be detachably attached to the integral new cross member 90 may be provided for said member, which device is supported on the top chords 33 of the existing framework 6, for example.

The invention claimed is:

1. A method for modernizing an existing escalator or an existing moving walkway, the method comprising:

of removing all electrical and mechanical parts from an existing framework of the existing escalator or of the existing moving walkway, the existing framework having two framework side parts and a base structure connecting said framework side parts, and the framework side parts being connected to each other with cross members disposed at a distance from the base structure, and removing all the cross members of the existing framework and replacing at least part of the removed cross members with new cross members, the two framework side parts of the existing framework being connected to each other in a mutually stabilizing manner at least at one point at a distance from the base structure of the framework, during replacement of the cross members.

2. The method according to claim 1, wherein the cross members are sequentially replaced in order to stabilize the two framework side parts, such that as the operation proceeds, the framework side parts are connected to each other in a mutually stabilizing manner at a distance from the base structure decreasingly with existing cross members and increasingly with new cross members due to the sequential replacement.

3. The method according to claim 1, wherein before the cross members for stabilizing the two framework side parts are removed, at least one stabilizing apparatus is fastened to the existing framework, wherein the at least one stabilizing apparatus connects the framework side parts in a mutually stabilizing manner at a point at a distance from the base structure of the existing framework, wherein after the at least one stabilizing apparatus is fastened, the cross members are removed and new cross members are inserted, and after the new cross members are inserted, the at least one stabilizing apparatus is removed.

4. The method according to claim 3, wherein the at least one stabilizing apparatus comprises a stabilizing member detachably disposed on the framework side parts.

5. The method according to claim 1, wherein the position of the new cross members the existing framework is determined from the installation space required for the modernizing components to be newly inserted and in relation to the height of the framework side parts.

6. The method according to claim 5, wherein the position is established as a distance from the top chords of the framework side parts towards lower bottom chords of the framework side parts as an instruction for positioning the new cross members.

7. The method according to claim 1, wherein the existing cross members are welded on a first lateral surface of framework webs of the framework side parts and in each case the existing cross members of the framework webs are first removed and then the new cross members are fastened to a second lateral surface of the framework web.

8. The method according to claim 1, wherein a first deflecting module having rail interfaces is installed in the framework provided with new cross members at a first end of the framework and a second deflecting module having rail interfaces is installed in the framework at a second end of the framework.

9. The method according to claim 8, wherein a target device is disposed at the rail interfaces of the first deflecting module and an alignment device is disposed at the rail interfaces of the second deflecting module, and wherein the alignment device is adjusted to the target device, wherein further components to be inserted into the framework between the deflecting modules can be aligned on the alignment device.

10. The method according to claim 9, wherein a frame assembly apparatus is available, which frame assembly apparatus is first provided with a right-hand frame and a left-hand frame provided receptacles, then the frame assembly apparatus is placed onto a new cross member, subsequently the frame assembly apparatus is aligned to the alignment device a separate adjustment device, then the frames held in alignment by the frame assembly apparatus are fastened to the new cross members, and finally the frame assembly apparatus is removed from the new cross member provided with frames.

11. The method according to claim 10, wherein the framework provided with new cross members, frames and deflecting modules is completed with new rails, drive components, control components, a new step band or palette band, with cladding parts, balustrades and handrails, to form a modernized escalator or a modernized moving walkway.

12. A set of devices for carrying out a modernizing method on an existing escalator or on an existing moving walkway according to claim 10, wherein the set of devices comprises:

at least one alignment device having support points that can be aligned with rail interfaces of deflecting modules, at least one target device having support points that can be aligned with rail interfaces deflecting modules, the alignment device being adjustable to the target device when installed, at least one frame assembly apparatus matched to the new cross member, which apparatus has an adjustment device and at least one receptacle for at least one frame.

13. The set of devices according to claim 12, wherein the adjustment device comprises two mutually distally disposed setting devices which are supported on the new cross member for the purposes of adjustment, and the adjustment device further contains an alignment aperture having a hole or a notch having a groove, wherein the diameter of the hole or the cross section of the groove is matched to the alignment means of the alignment device.

* * * * *